US011965248B2

(12) United States Patent
Pillhoefer et al.

(10) Patent No.: US 11,965,248 B2
(45) Date of Patent: Apr. 23, 2024

(54) METHOD FOR COATING A METALLIC SURFACE

(71) Applicant: MTU Aero Engines AG, Munich (DE)

(72) Inventors: Horst Pillhoefer, Roehrmoos (DE); Max Morant, Aschau (DE); Philipp Lautenbacher, Munich (DE); Ludwig Hilser, Munich (DE)

(73) Assignee: MTU AERO ENGINES AG, Munich (DE)

( * ) Notice: Subject to any disclaimer, the term of this patent is extended or adjusted under 35 U.S.C. 154(b) by 764 days.

(21) Appl. No.: 16/417,743

(22) Filed: May 21, 2019

(65) Prior Publication Data

US 2019/0360106 A1 Nov. 28, 2019

(30) Foreign Application Priority Data

May 23, 2018 (DE) ..... 102018208071.2

(51) Int. Cl.

| | |
|---|---|
| ***C23C 28/02*** | (2006.01) |
| ***C23C 22/50*** | (2006.01) |
| ***C23C 28/00*** | (2006.01) |
| ***C23C 28/04*** | (2006.01) |

(52) U.S. Cl.
CPC ..... *C23C 28/021* (2013.01); *C23C 22/50* (2013.01); *C23C 28/042* (2013.01); *C23C 28/44* (2013.01)

(58) Field of Classification Search
None
See application file for complete search history.

(56) References Cited

U.S. PATENT DOCUMENTS 4,479,824 A * 10/1984 Schutt ..... C09D 5/10 106/1.05
6,440,499 B1 8/2002 Wydra
2005/0031877 A1* 2/2005 Gigliotti, Jr. ..... C23C 10/30 428/457
2005/0233084 A1 10/2005 Marty
2006/0029814 A1 2/2006 Bhatia
2006/0243415 A1* 11/2006 Holub ..... G01J 3/524 164/130
2007/0044704 A1* 3/2007 Osborne ..... C09D 5/002 116/206
2016/0003092 A1 1/2016 Chamberlain

FOREIGN PATENT DOCUMENTS

| | | | |
|---|---|---|---|
| DE | 19807636 | C1 | 11/1999 |
| EP | 0347053 | A2 | 12/1989 |
| EP | 1626038 | A2 | 2/2006 |
| EP | 2962844 | A2 | 1/2016 |
| JP | 2009209440 | A | 9/2009 |

OTHER PUBLICATIONS

Fischer Scientific, Aluminum powder Alfa Aesar, p. 1-3, Accessed online at https://www.fishersci.com/shop/products/aluminum-powder-alfa-aesar-3/AA4100130 on Aug. 4, 2021 (Year: 2021).*
Vincentz Network: "Sensing paint thickness" Aug. 7, 2004 found on internet: www.european-coatings.com > content > download > verison p. 44(1) col. 1 to p. 44(2) col. 4.

* cited by examiner

*Primary Examiner* — Tabatha L Penny
(74) *Attorney, Agent, or Firm* — Abel Schillinger, LLP

(57) ABSTRACT

The invention relates to a method for providing a metallic surface with a coating by applying one or more layers of one or more metal-containing slips to the surface. At least one of the slips comprises a coloring and/or color-imparting substance which has no influence on the properties of the completed coating and/or can be decomposed by thermal treatment, and the local thickness of the applied slip layer is determined on the basis of the local color intensity of the layer.

20 Claims, 2 Drawing Sheets

METHOD FOR COATING A METALLIC SURFACE

CROSS-REFERENCE TO RELATED APPLICATIONS

The present application claims priority under 35 U.S.C. § 119 of German Patent Application No. 102018208071.2, filed May 23, 2018, the entire disclosure of which is expressly incorporated by reference herein.

BACKGROUND OF THE INVENTION

1. Field of the Invention

The present invention relates to a method for coating a metallic surface, such as, for example, a surface of a component of a turbomachine, with a metal-containing slip, and especially to a method which allows the uniformity of thickness of the applied slip layer to be assessed visually.

2. Discussion of Background Information

In the field of gas turbines, such as stationary gas turbines or aircraft engines, turbine blades made, for example, of nickel-based or cobalt-based superalloys are typically protected against oxidation and corrosion at the high temperatures prevailing during operation of the gas turbines by being provided with protective diffusion layers. For this purpose, for example, a slip containing aluminum and/or chromium is applied to the blade or a part thereof, generally in two or more layers, whereupon the blade thus coated is heated to high temperatures (600° C. to 1200° C., for example) in order to thereby bring about diffusion of the slip metals into the blade surface and to improve the oxidation and corrosion resistance of the surface. The slip is typically applied to the blade by manual spraying, because robot-assisted spraying is too expensive and complicated and disruptions in the supply of slip and in the functioning of the spraying nozzle are undetectable or detectable only at great cost and complexity. With manual application of the slip in one or more coats (layers), however, it is very difficult, if not impossible, to apply the "green" slip coat with uniform thickness. The reason for this is that a typical slip, with constituents made up of metal powder, binder, and solvent, generally has a gray color before and after drying, and hence the same color as the surface of the metallic substrate to which the slip is applied; this makes it virtually impossible to make a visual assessment of whether and to what extent the applied slip layer has a uniform thickness. For this reason, the coating of metal substrates with metal-containing slip has to date been limited to relatively small regions of components, such as, for example, the underplatform region of a turbine blade, since in the case of relatively large areas to be coated (e.g., entire blade airfoil, entire guide vane), the resulting diffusion layers exhibit large, unacceptable fluctuation ranges in their layer thickness.

In view of the foregoing, it would therefore be advantageous to have available a method for coating a metallic surface with a metal-containing slip that enables an assessment to be made, without great expense or complexity, visually and/or with simple technical means, of whether and, if so, to what extent the applied slip layer has a uniform thickness.

SUMMARY OF THE INVENTION

The present invention provides a method for providing a metallic surface with a coating by applying one or more layers of one or more metal-containing slips to the surface. At least one of the one or more slips comprises at least one coloring and/or color-imparting substance which has no influence on the properties of the completed coating and/or can be decomposed by thermal treatment. The local thickness of an applied slip layer is determined on the basis of a local color intensity of the layer.

In one aspect of the method, the metallic surface may be the surface of a component of a turbomachine such as, e.g., an airfoil of a rotor blade or of a guide vane.

In another aspect, the metallic surface may comprise or consist of a nickel-based, cobalt-based and/or iron-based alloy.

In yet another aspect, the at least one metal-containing slip may comprise aluminum and/or an aluminum alloy. For example, the slip may comprise particles of aluminum and of AlSi and/or AlY.

In a still further aspect, the at least one coloring and/or color-imparting substance may comprise at least one metal-containing pigment such as, e.g., a metal oxide, and/or it may comprise at least one organic dye such as, e.g., an azo-pigment. The organic dye may be thermally decomposable with loss of its color.

In another aspect of the method, the at least one coloring and/or color-imparting substance may comprise at least one substance which upon irradiation with UV and/or IR rays results in coloration of the slip.

In another aspect, at least one of the one or more metal-containing slips may comprise a flatting agent such as, e.g. silica gel.

In another aspect, two or more slip layers may be applied and before one layer is applied to a layer that has already been applied, the layer that has already been applied may optionally be dried. Further, the first layer may be formed with a slip which comprises the at least one coloring and/or color-imparting substance, and atop the first layer a second layer may be applied of a slip which comprises no coloring and/or color-imparting substance. One or more further slip layers may be applied to the second layer, with alternation between slips with coloring and/or color-imparting substance and slips without coloring and/or color-imparting substance.

In another aspect of the method, a determination of the local color intensity of the applied slip layer may comprise a comparison with calibrated specimen color tables and/or a measurement with one or more photosensors.

In another aspect, one or more slips may be applied by manual spraying.

In another aspect, a coated area of the metallic substrate may be at least 4 $cm^2$ in size.

The present invention also provides a metal-containing slip for producing a coating by the method of the instant invention (including the various aspects thereof). The slip comprises at least one coloring and/or color-imparting substance in a concentration which allows the local thickness of a layer of the slip applied to the metal surface to be determined and/or assessed visually and/or by simple technical means on the basis of the local color intensity of the layer.

In the method of the invention for providing a metallic surface (e.g., a surface of a component of a turbomachine) with a coating of uniform thickness, one or more layers (preferably at least two layers or coats) of one or more metal-containing slips are applied to the surface that is to be coated; before one layer is applied to a layer that has already been applied, the layer that has already been applied is preferably dried. At least one of the slips used or the (only)

slip used comprises at least one coloring and/or color-imparting substance which has no influence on the properties of the completed coating and/or can be decomposed by thermal treatment, and the local thickness of the applied slip layer can be determined on the basis of the local color intensity of the layer. By comparing color intensities at different locations of the layer it is also possible to assess the uniformity of the layer thickness. Additionally, the layer thickness can be adjusted in this way such as to maximize the uniformity of the layer thickness on the whole of the surface to be coated.

In other words, with the method of the invention, the thickness of the slip layer at a particular location of the coated surface is determined and/or assessed on the basis of the color intensity at that location, with a lower layer thickness resulting in a lower color intensity than a higher layer thickness. A substantially uniform color intensity across the entire surface to be coated is therefore an indicator of a substantially uniform layer thickness. In the case of nonuniform color intensity, further slip can be applied (by spraying, for example) at locations with lower color intensity, until the desired color intensity (and hence the desired layer thickness) is achieved at these locations also. If there is no need for determination of the layer thickness, it is possible, through a visual comparison of the color intensities at different locations of the layer, at least to assess whether the layer is sufficiently uniform or not.

Conversely, in a further embodiment of the method of the invention, it is also possible to apply a (typically gray) metal-containing slip without coloring and/or color-imparting substance to a colored slip layer that has already been applied (and preferably dried) and to determine and/or assess the thickness and uniformity of the thickness of the layer of the (gray) slip on the basis of the color intensity, with in this case a lower color intensity indicating a higher layer thickness (the greater the layer thickness, the greater the extent to which the color causes the color of the underlying colored layer to fade). Instead of the slip without color and/or color-imparting substance, it is also possible, optionally, to employ a slip whose color differs significantly from the color of the layer that has already been applied, and so results, following the application of the slip, in a mixed color of the layer.

In another embodiment of the method of the invention, it is possible to use a coloring and/or color-imparting substance which can be decomposed thermally at relatively low temperatures and in that case loses its color. Following application of the layer, the layer undergoes a thermal treatment (drying, for example) at a temperature at which the substance decomposes. Accordingly, atop this now decolorized layer, it is possible in turn to apply a slip with colored and/or color-imparting substance and to subject the newly applied layer to thermal treatment. This procedure can be repeated as often as required until the desired (total) layer thickness is reached.

In the case of coating with two or more layers, the methods outlined above may also be combined with one another in any desired way.

It is of course possible in the method of the invention to use slips differing in composition (e.g., with different metals or different metal compositions) and/or different coloring and/or color-imparting substances (e.g., with different colors). Corresponding slips may be used in alternation or in any desired order. These slips are preferably applied to a slip layer that has already been dried.

Generally speaking, a slip is applied at room temperature (20-25° C.). The temperature of the surface to be coated, however, may also be significantly higher, but preferably not higher than 400° C. After the slip has been applied, the resulting layer is preferably dried before the next layer is applied. Drying takes place preferably at elevated temperature, in the range from 80° C. to 400° C., for example. It is possible for two, three, four, five, six, seven, eight, nine, ten or more layers to be applied in succession. The thickness of an as yet undried layer is often in the range from 1 μm to 60 μm, e.g., in the range from 5 μm to 30 μm. Drying reduces the thickness of the layer, with the extent of the reduction being dependent on factors including the solids content of the slip used. The thickness of the completed coating (after application and drying of all layers) is in many cases in the range from 2 μm to 500 μm, as for example in the range from 10 μm to 300 μm.

Determining the local color intensity of an applied (preferably as yet undried) layer may be accomplished, for example, by calibration, with the aid, for example, of calibrated photosensors and/or of colored comparative image standards (e.g., standardized specimen color tables).

The method of the invention allows the coating even of relatively large areas, examples being areas with a size of at least 4 $cm^2$, at least 5 $cm^2$, at least 6 $cm^2$, at least 7 $cm^2$, at least 8 $cm^2$, at least 10 $cm^2$, at least 15 $cm^2$, at least 20 $cm^2$, at least 25 $cm^2$, at least 30 $cm^2$, at least 40 $cm^2$ or at least 50 $cm^2$, with a scatter in the layer thickness of, for example, not more than 20% of the mean layer thickness (e.g., 75 μm mean layer thickness−scatter=+/−15 μm).

The metallic surface to be coated may consist of a metal and/or of an alloy. Preferred examples of alloys include those used in the production of components of turbomachines, particularly what are called superalloys based on nickel and/or cobalt and/or iron and comprising one or more additional metals, such as, for example, Cr, Re, Al, W, Mo, Nb, Ta, Ti, and any desired combinations thereof. Particularly in the case of these superalloys it is preferred for at least one of the slips employed in the method to comprise particles of aluminum and/or of one or more aluminum alloys, optionally in combination with particles of one or more other metals, such as, for example, Cr, Fe, Co, Pd, Pt, Ru, Rh, Os, Ir, Y, Sc, lanthanides. Examples of preferred aluminum alloys include AlSi, AlCr, AlSiCr, and AlY.

Nonlimiting examples of metal substrates which can be coated using the method of the invention include components of turbomachines (especially gas turbines), examples being airfoils of guide vanes and rotor blades, blade shrouds, blade platforms, and parts of these components.

The method of the invention is suitable not only for the original coating but also for the after-coating (repair), in other words for the coating of a substrate whose worn-down and/or damaged coating has been removed completely or at one or more locations and requires renovation there.

The at least one coloring and/or color-imparting substance present in the slip or in at least one of the slips may be selected from any of a very wide variety of organic and inorganic compounds. Mixtures of two or more different coloring and/or color-imparting substances may also be employed, either in the same slip or in mutually different slips.

Examples of inorganic coloring and/or color-imparting substances are metal-containing pigments such as metal oxides, for example. The metals are often selected from Fe, Co, Ni, Ti, Al, and mixtures thereof. These metal pigments (e.g., metal oxides) may comprise one or more metals, and hence also include mixed oxides, for example. Nonlimiting examples of metal oxides suitable for the method of the invention include $NiO_x$, FeO, $Fe_2O_3$, $TiO_x$, $CoO_x$, CoAlO, and spinels composed of mixed metal oxides (e.g., with the formula $Me_xM_y2O_z$). The average particle size of these pigments (if they do not dissolve in the slip) is preferably smaller by a factor of 20 to 500 than the desired layer thickness of the ultimate layer, and in many cases is in the range from 1 μm to 20 μm, e.g., in the range from 2 μm to 10 μm. The concentration of metal-containing pigment in the slip is dependent on a variety of factors, such as, for example, the coloring power and the color of the pigment, but is often in the range from 0.1 to 20 wt %, based on the overall mass of the slip. The concentration, however, may also be significantly higher—for example, up to 40 wt %.

Further examples of coloring and/or color-imparting substances suitable for the method of the invention are organic dyes, preferably those which can be decomposed thermally at relatively low temperatures, especially temperatures of no higher than 400° C., preferably no higher than 200° C. or no higher than 150° C., and in that case at least substantially lose their coloring and/or color-imparting effect. One preferred class of organic dyes are azo pigments, although all known classes of organic dyes can be employed, as long as they have the properties specified above. In the slip these dyes are preferably present in a dissolved form.

A similar effect to that achieved with thermally decomposable coloring and/or color-imparting substances can be achieved with substances which are not thermally decomposable, or not at a suitable temperature, if the slip comprising the coloring and/or color-imparting substance is admixed with a flatting agent such as silica gel, for example, that only slightly lowers the color intensity of the slip but causes severe fading of the color of the slip after it has been dried.

Other examples of coloring and/or color-imparting substances suitable for the method of the invention are (generally organic) compounds which, while evoking little or no coloration of the slip under daylight, nevertheless give rise to a significant coloration of the slip on irradiation with UV and/or IR rays—through fluorescence, for example.

The skilled person will recognize that the method of the invention is suitable not only for the production of diffusion layers but instead very generally for the production of a coating on a metallic surface. Accordingly, the slips that can be used are also not confined to the above-specified aluminum-containing slips, but instead include all metal-containing slips with constituents which are needed for producing a coating having the particular desired properties on a stipulated metallic surface.

Regarding the details of producing a diffusion layer on a metallic surface, reference may be made, for example, to US 2005/0031877, the entire disclosure of which is incorporated by reference herein.

Generally speaking, a slip suitable for the method of the invention comprises at least two essential constituents, namely particulate metal (including alloy) and binder. The slip typically also includes a solvent or a solvent mixture.

Suitable binders are all conventional binders, especially organic polymers (resins). Nonlimiting examples of such polymers are those which are also employed in commercial paints and coatings. Specific examples of binders include epoxy resins, silicones, alkyd resins, acrylic resins, polyurethanes, polyvinyl chloride, polyvinyl alcohol, phenolic resins, polyesters, polyamides, and polyolefins.

Examples of suitable solvents are those used in the coatings industry. Specific nonlimiting examples include alcohols such as methanol, ethanol, isopropanol, and butanol; glycols and glycol-containing compounds such as ethylene glycol and ethylene glycol alkyl ethers; ethers, esters, amines, amides, ketones, aldehydes, aromatic compounds such as toluene and xylene; and chlorinated hydrocarbons.

The slip may be applied to the metallic surface in any desired way, as for example by means of technologies which are known in the coatings industry, such as spraying, spreading, dipping, pouring, roll coating, and spin coating. Spraying, especially manual spraying using a spray gun, is a preferred method for producing a diffusion coating.

In the production of a diffusion layer, when all of the slip layers have been applied (and preferably dried), the coated substrate is heated to a temperature enabling the aluminum in the layer or layers to diffuse in the coated surface of the substrate (typically under an inert gas atmosphere such as argon or nitrogen, for example). The temperature required for this purpose is dependent on a variety of factors, including the composition of the substrate, the desired depth of penetration into the substrate, the composition of the slip, and the thickness of the slip layer(s). In the majority of cases, this temperature is in the range from around 600° C. to around 1200° C., more particularly in the range from around 800° C. to around 950° C.

BRIEF DESCRIPTION OF THE DRAWINGS

In the appended drawings.

DETAILED DESCRIPTION OF EMBODIMENTS OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description in combination with the drawings making apparent to those of skill in the art how the several forms of the present invention may be embodied in practice.

EXAMPLE 1

Figure 1:
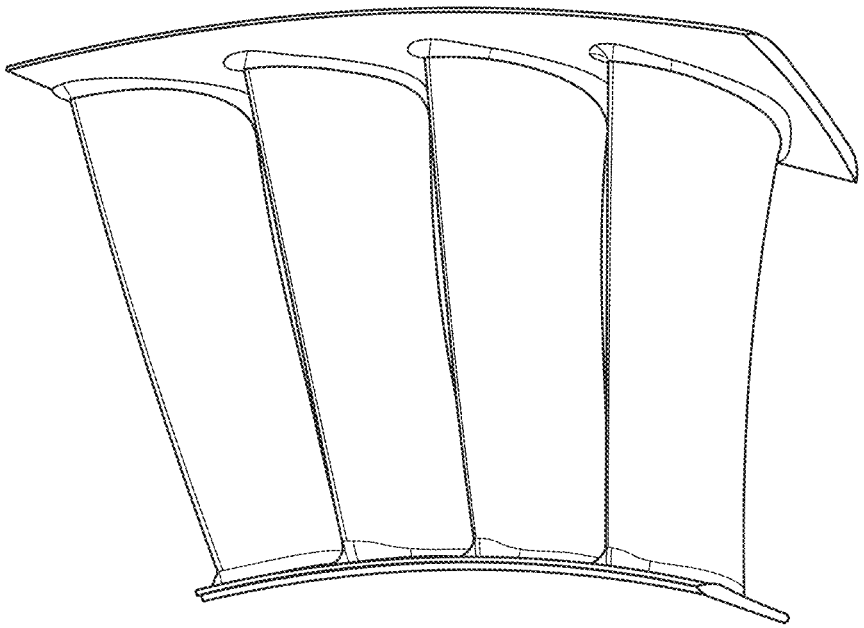
FIG. 1 shows a turbine guide vabe segment of the kind coated in Example 1 below.

Described below is the AlSi diffusion coating of a turbine guide vane segment with four individual airfoils, shown in FIG. 1. The segment consists of the nickel-base precision casting alloy MAR-M247 LC. The dimensions of an airfoil are around 200 mm times 200 mm. The vanes throughout the gas channel are to receive a diffusion coating with a layer thickness of 40-100 μm, while the radii and fits on the platform mountings are to be left free of the coating.

The slip used is a suspension of Al particles and AlSi particles with a particle size of 2-10 μm (volume fraction 20%), with a binder based on polyvinyl alcohol, the suspension having been adjusted using glycerol and distilled water such that its dynamic viscosity at 15-30° C. is 1000-2000 mPa·s.

This base slip is gray. A blue version of this base slip is produced by adding blue metal oxide (CoAl spinel) to the base slip at 5 wt %, based on the total weight of the base slip.

The production of the "green" component slip takes place in the following steps:

1. Gentle blasting of the guide vane segment with $Al_2O_3$ powder.
2. Thermal degreasing of the segment at 240° C. for an hour.
3. Uniform application of a first blue slip layer with a thickness of 10 μm to the component in 2-3 overlapping spray passes, using a small spray gun with capacity for precision metering. The uniform layer thickness is recognizable through the uniform blue hue of the layer.
4. Drying of the coated component at 200° C. for 30 minutes and subsequent cooling to room temperature.
5. Application of a second layer composed of gray base slip by spraying with a spray gun in 2-4 overlapping spray passes, setting a layer thickness of 20 μm+/−5 μm. In this case, the blue shading of the underlying layer is visually masked. The layer thickness is adjusted by comparison with standardized specimen color tables, produced in a foundation test with known layer thicknesses.
6. Drying of the coated component at 200° C. for 30 minutes and subsequent cooling to room temperature.
7. Application of a third layer composed of blue slip by spraying with a spray gun in 3-6 overlapping spray passes, setting a layer thickness of 20 μm+/−5 μm. The layer thus produced has a blue shading. The uniformity of the layer thickness is assessed by comparison with standardized specimen color tables, produced in a foundation test with known layer thicknesses.
8. Drying of the coated component at 200° C. for 30 minutes and subsequent cooling to room temperature.
9. Repetition of steps 5. to 8. until a total slip thickness of 150 μm+/−10 μm is achieved.
10. Final drying at 220° C. for 1 hour.
11. Diffusion heat-treatment of the "green" component" at 900° C. for 4 hours in argon.

The Al diffusion layer obtained (with an Si fraction of up to 4%) has a layer thickness of 75 μm over the entire component, with a scatter of only +/−15 μm, even on leading and trailing edges. The transitions in the gas channel between the two middle vane airfoils are also situated within this tolerance.

EXAMPLE 2

Figure 2:
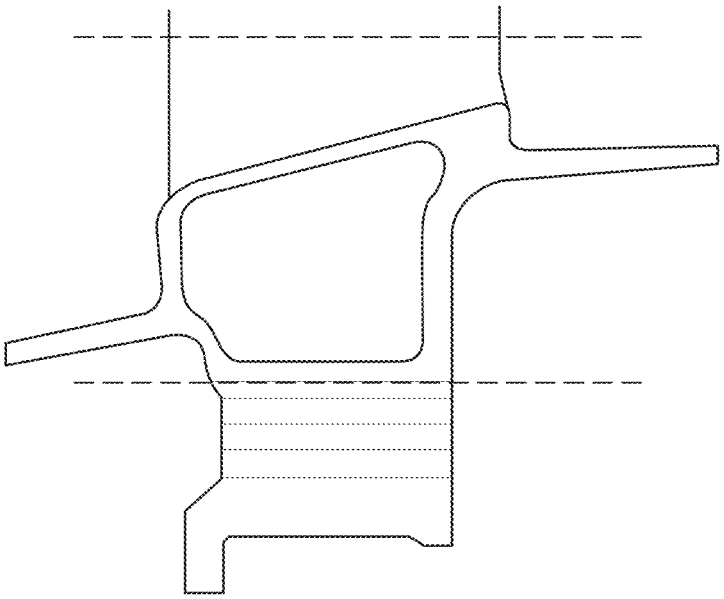
FIG. 2 shows the root shroud region of a turbine blade of the kind coated in Example 2 below.

FIG. 2 shows the root shroud region of a turbine blade intended for repair, in which the alitizing layer depleted locally by operation has been removed to an extent of up to 10% of the blade height by stripping with suitable methods, and whose metallic surface without oxidation and sulfidation residues is to be recoated.

The slip used is a suspension of Al particles and AlSi particles with a particle size of primarily 1-5 μm in a volume fraction of 30%, with a binder based on polyvinyl alcohol in glycol and water as solvents (dynamic viscosity at 15-30° C.=1000-2000 mPa·s). This slip additionally contains 5 vol % of azo pigment, which gives the slip a yellow color and is thermally stable up to around 140° C.

The production of the "green" component slip takes place in the following steps:

1. Gentle blasting of the local root shroud within the region shown between the dashed lines in FIG. 2 with $Al_2O_3$ powder.
2. Thermal degreasing at 240° C. for one hour.
3. Uniform application of a first yellow slip layer with a thickness of 10 μm to the component in 2-3 overlapping spray passes, using a small spray gun with capacity for precision metering. The uniform layer thickness is recognizable through the uniform yellow hue of the layer.
4. Drying of the coated component at 240° C. for 30 minutes and subsequent cooling to room temperature.
5. Application of a second layer composed of yellow slip by spraying with a spray gun in 2-4 overlapping spray passes to the substrate, which is now colored gray again, comprising the first slip layer (see 5. of Example 1).
6. Drying of the coated component at 240° C. for 30 minutes and subsequent cooling to room temperature.
7. Repetition of steps 3. and 4. until a total slip thickness of 120 μm+/−10 μm is achieved.
8. Diffusion heat-treatment of the "green" component" at 900° C. for 4 hours in argon.

The Al diffusion layer obtained (with an Si fraction of up to 4%) has a layer thickness of 60 μm over the partial local root region, with a scatter of only +/−10 μm. Even the geometrically complex pocket with narrow outer and inner radii is uniform within this layer thickness tolerance.

EXAMPLE 3

The present example uses a colored slip in order to produce a Y-alloyed aluminide diffusion coating on a guide vane in the gas channel. In overlay coatings of the MeCrAlY type, yttrium has the positive quality of improving the adhesion of $\alpha$-$Al_2O_3$ on an NiAlY surface and at the same time of binding elements which disrupt the construction of oxide, such as S and also V, Ta, Zr, Hf from the base material, to the benefit of the oxidation lifetime of the alitizing.

The slip used is a suspension of Al, AlSi, and AlY particles having a particle size<5 μm (80 wt % Al+AlSi, 20 wt % AlY) (volume fraction 40%), with the AlY alloy including a Y fraction of 10 to 20 wt %. The slip comprises polyvinyl alcohol-based binder and is adjusted with glycol and distilled water to a dynamic viscosity at room temperature of 1000-2000 mPa·s.

The slip additionally contains 5 wt % of chromium hematite spinel ($Cr_xFe_yO_z$) as green pigment and 2 wt % of silica gel as flatting agent. As a result of the flatting agent, the coat of slip after drying becomes matt, and the green coloration undergoes significant fading.

The "green" component slip is produced in the following steps:

1. Gentle blasting of the blade vane in the gas channel with adjoining blade root pocket with $Al_2O_3$ powder (220 mesh, 1.5 bar injector system).
2. Thermal degreasing at 240° C. for an hour.
3. Uniform application of a first green slip layer using a small spray gun with capacity for precision metering.
4. Further procedure is as in Example 2.
5. Diffusion heat-treatment of the "green" component at 900° C. for 4 hours and subsequently at 1080° C. for 2 hours in argon.

The result is a layer with primarily NiAl-intermetallic phase and Y present integrally in the phase in a concentration of 0.5-1 wt %.

What is claimed is:

1. A method for providing a metallic surface with a coating by applying one or more layers of one or more metal-containing slips to the surface, wherein at least one of the one or more slips comprises metal-based particles, is gray and further comprises at least one coloring and/or color-imparting substance which has no influence on the properties of the completed coating and/or can be decomposed by thermal treatment, and the local thickness of an applied slip layer is determined on the basis of a local color intensity of the layer.

2. The method of claim 1, wherein the metallic surface is that of a component of a turbomachine.

3. The method of claim 1, wherein the metallic surface comprises or consists of a nickel-based, cobalt-based and/or iron-based alloy.

4. The method of claim 1, wherein at least one metal-containing slip comprises particles of aluminum and/or an aluminum alloy.

5. The method of claim 1, wherein at least one metal-containing slip comprises particles of aluminum and of AlSi and/or AlY.

6. The method of claim 1, wherein the at least one coloring and/or color-imparting substance comprises at least one metal-containing pigment.

7. The method of claim 6, wherein the at least one coloring and/or color-imparting substance comprises one or more metal oxides.

8. The method of claim 1, wherein the at least one coloring and/or color-imparting substance comprises at least one organic dye.

9. The method of claim 8, wherein the at least one organic dye can be decomposed thermally with loss of its color.

10. The method of claim 8, wherein the at least one organic dye comprises an azo pigment.

11. The method of claim 1, wherein the at least one coloring and/or color-imparting substance comprises at least one substance which upon irradiation with UV and/or IR rays results in coloration of the slip.

12. The method of claim 1, wherein the at least one of the one or more metal-containing slips which comprises at least one coloring and/or color-imparting substance further comprises a flatting agent.

13. The method of claim 12, the flatting agent comprises silica gel.

14. The method of claim 1, wherein two or more slip layers are applied and before one layer is applied to a layer that has already been applied, the layer that has already been applied is optionally dried.

15. The method of claim 14, wherein the first layer is formed with a slip which comprises the at least one coloring and/or color-imparting substance, and atop the first layer a second layer is applied of a slip which comprises no coloring and/or color-imparting substance.

16. The method of claim 15, wherein one or more further slip layers are applied to the second layer, with alternation between slips with coloring and/or color-imparting substance and slips without coloring and/or color-imparting substance.

17. The method of claim 1, wherein a determination of the local color intensity of the applied slip layer comprises a comparison with calibrated specimen color tables.

18. The method of claim 1, wherein one or more slips are applied by manual spraying.

19. The method of claim 1, wherein a coated area of the metallic substrate is at least 4 $cm^2$ in size.

20. The method of claim 1, wherein a determination of the local color intensity of the applied slip layer comprises a measurement with one or more photo sensors.

* * * * *